US007090217B1

(12) United States Patent
Siron

(10) Patent No.: US 7,090,217 B1
(45) Date of Patent: Aug. 15, 2006

(54) COMPONENT CRAPS STICK

(76) Inventor: John R. Siron, 8447 De Soto Ave. #2, Canoga Park, CA (US) 91304

( * ) Notice: Subject to any disclaimer, the term of this patent is extended or adjusted under 35 U.S.C. 154(b) by 0 days.

(21) Appl. No.: 11/239,908

(22) Filed: Sep. 30, 2005

Related U.S. Application Data

(60) Provisional application No. 60/614,515, filed on Sep. 30, 2004.

(51) Int. Cl.
*A63F 9/00* (2006.01)

(52) U.S. Cl. ..... 273/148 R

(58) Field of Classification Search ..... 273/148 R
See application file for complete search history.

(56) References Cited

U.S. PATENT DOCUMENTS 1,226,152 A * 5/1917 Weslow ..... 273/119 A
3,017,186 A * 1/1962 Ascardi ..... 273/108
4,624,494 A * 11/1986 Huppert ..... 294/26
5,487,576 A * 1/1996 DuVivier ..... 294/19.1
D367,903 S * 3/1996 Hurlbert ..... D21/457
D459,959 S * 7/2002 Fetterman et al. ..... D8/14
6,450,557 B1 * 9/2002 Martinez ..... 294/19.1
D493,680 S * 8/2004 Raymond ..... D8/14

OTHER PUBLICATIONS www.gamelandsports.com.*

* cited by examiner

*Primary Examiner*—Eugene Kim
*Assistant Examiner*—Dolores R. Collins
(74) *Attorney, Agent, or Firm*—Walter Unterberg

(57) ABSTRACT

This invention is a component craps stick for manipulating dice in a gaming casino, formed as a three-component detachable assembly of a rattan hook, a rattan shaft and a pinewood handle. The rattan components may be removed and replaced when they deteriorate or break due to flexural fatigue in extensive casino use. The three-component configuration is a distinct improvement over currently used single-piece rattan craps sticks which must be totally replaced when any part deteriorates or breaks.

5 Claims, 1 Drawing Sheet

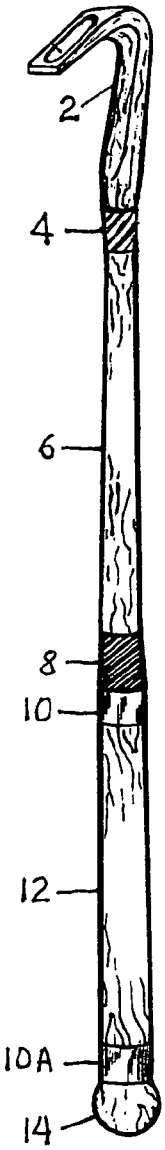
FIG. 1
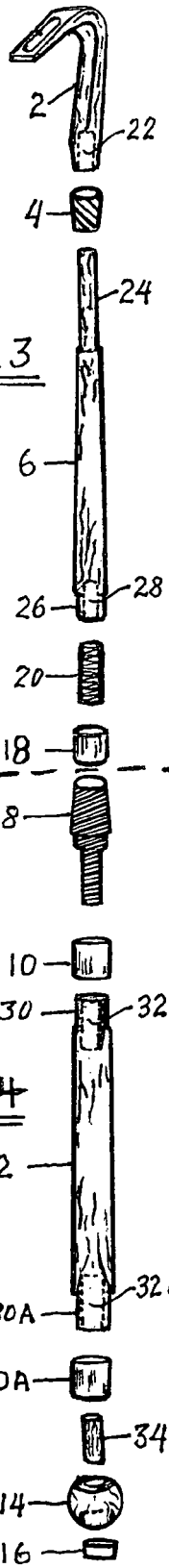
FIG. 3
FIG. 4
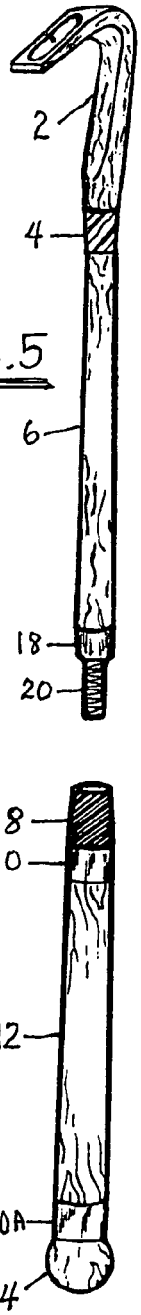
FIG. 5
FIG. 2

COMPONENT CRAPS STICK

RELATED U.S. APPLICATION DATA

This application claims the benefit of Provisional Application No. 60/614,515 filed 30 Sep. 2004.

BACKGROUND OF THE INVENTION

1. Field of the Invention

This invention relates to craps sticks which are used in casinos to manipulate dice in crap games, such as hooking-up, retrieving and pulling the two dice after each throw.

2. Description of Related Art

Currently existing craps sticks are made from a single piece of rattan, bent to a hook shape at the small end. Because of primitive working, these sticks appear crude. Due to the properties of rattan, the following types of deterioration occur and limit stick life:

a. hook unbending and straightening out;
b. shaft (between hook and handle) subjected to constant bending in normal use, lacks flexibility and breaks due to fatigue failure;
c. handle at the free end exhibits splinters.

When any deterioration takes place, the one-piece stick cannot be repaired. It must be discarded and replaced.

A U.S. patent search was conducted in this art, resulting in the following patents:

U.S. Pat. No. 1,226,152 (1917) to Weslow
D493680 (2004) to Raymond
D367903 (1996) to Hurlbert
U.S. Pat. No. 5,487,576 (1996) to DuVivier
D459959 (2002) to Fetterman et al
U.S. Pat. No. 6,450,557 (2002) to Martinez
U.S. Pat. No. 4,624,494 (1986) to Huppert
U.S. Pat. No. 3,017,186 (1962) to Ascardi None of these patents related to the gaming casino application.

SUMMARY OF THE INVENTION

The craps stick of the present invention is a detachable assembly of 3 components: a rattan hook, a rattan shaft and a pinewood handle.

This component structure eliminates or delays the types of deterioration noted under a., b., and c. above, extends stick life, and permits a worn out or broken rattan shaft or hook to be easily removed and replaced.

Furthermore, it includes a magnet, placed at the free end of the handle, which is used by the stick person to detect any loaded dice.

BRIEF DESCRIPTION OF THE FIGURES

A better understanding of the craps stick invention may be gained by reference to the Detailed Description of the Invention which follows, in conjunction with the Figures, wherein FIG. 1 is an external view of the complete assembly of the components craps stick of the invention, comprising hook, shaft and handle;

FIG. 5 is an external view of the sub-assembly of hook and shaft;

FIG. 2 is an external view of the assembled handle, mateable with the hook and shaft sub-assembly of FIG. 5 to produce the complete assembly of FIG. 1;

FIG. 3 is an exploded view of the hook and shaft sub-assembly of FIG. 5; and FIG. 4 is an exploded view of the assembled handle of FIG. 2.

DETAILED DESCRIPTION OF THE INVENTION

Referring now to FIG. 1, an external view of the complete assembly of the component craps stick of the invention is shown. Ferrule 4 (see FIG. 3) is located between rattan hook 2 and rattan shaft 6. Ferrule 8 (see FIG. 4) and brass ring 10 are located between shaft 6 and pinewood handle 12. Birchwood ball 14, with embedded magnet 16 (see FIG. 4) forms the free end of handle 12 via brass ring 10A.

Referring now to FIGS. 5 and 2, there is shown the connection between shaft 6 and handle 12, with stud 20 threaded into ferrule 8. All other callouts are the same as in FIG. 1.

Referring now to FIGS. 3 and 4, these are exploded views of FIG. 5 and FIG. 2 respectively. Hook 2 is made from rattan stem soaked in a non-toxic chemical solution, bent to the hook shape, molded and kiln-dried to stay angled.

Hollow cylinder 22 at the lower end of hook 2 engages pin 24 integral with upper end of shaft 6, which is made of rattan stem boiled in linseed oil for maximum flexibility. Molded plastic conical ferrule 4 (available in golf club stores) encases and spaces the joint of pin 24 in cylindrical hole 22. A brass ring 18 is fitted over the reduced diameter of shank 26 at the lower end of shaft 6.

At the lower end of shaft 6, cavity 28 houses a protruding nylon stud 20 which threads into the female threads of plastic ferrule 8 which is fixedly encased at its lower end in cavity 32 in the upper end of pinewood handle 12, to connect shaft 6 to handle 12. A brass ring 10 is fitted over the reduced diameter of shank 30 at the upper end of handle 12.

Referring to FIG. 4, peg 34 is fixedly encased at its upper end in the lower extremity of handle 12, while its lower end fits into a compatible cavity in birchwood ball 14, thus attaching ball 14 to handle 12. At the lower extremity of ball 14 a small indentation houses a magnet 16. A brass ring 10A is fitted over the reduced diameter of shank 30A at the free end of handle 12 to give the assembled appearance in FIG. 1 and FIG. 2.

ADVANTAGES OF THE INVENTION

In the complete assembly of FIG. 1 the various specified materials—rattan, birch, pine, brass, plastic—make for a pleasing appearance. The stickperson can use magnet 16 to test any dice for being loaded, rather than weigh dice in the palm of the hand.

The wood treatments and choices noted ensure that the geometry of hook 2 stays fixed, that shaft 6 remains flexible and that handle 12 will not splinter. In case of any deterioration, shaft 6 alone, or hook-shaft assembly of FIG. 5 can be replaced.

The design of the invention is geared toward survival of the thousands of cycles to which craps sticks are subjected in gaming casinos, which also results in cost savings over use of current equipment.

I claim:

1. A component craps stick for manipulating dice in a gaming casino, comprising:

a rattan hook;

a first attachment means located at a distal hook extremity;

a rattan shaft detachably attached to said rattan hook by said first attachment means;

a second attachment means located at an extremity of said shaft remote from said hook;

a pinewood handle detachably attached to said shaft by said second attachment means;

a third attachment means located at an extremity of said handle remote from said shaft; and a birchwood ball attached to said handle by said third attachment means;

whereby said hook and said shaft my be detached from said handle and replaced by a new said hook and a new said shaft.

2. The component craps stick of claim 1, further comprising a magnet embedded in the bottom of said birchwood ball, said magnet to be used to test for loaded dice.

3. The component craps stick of claim 2, wherein said first attachment means comprises a hollow cylinder in said hook engaging axially with a pin in said shaft, encased in a plastic ferrule.

4. The component craps stick of claim 2, wherein said second attachment means comprises a stud protruding from a first cavity in said shaft, engaging axially with a hollow plastic ferrule protruding from a second cavity in said handle, encased by a first brass ring.

5. The component craps stick of claim 2, wherein said third attachment means comprises a peg protruding from a third cavity in said handle engaging axially with a fourth cavity in said birchwood ball, encased by a second brass ring.

* * * * *